United States Patent [19]

Mulford

[11] Patent Number: 4,761,081

[45] Date of Patent: Aug. 2, 1988

[54] GLIDE SYSTEM FOR MINI-LOAD WAREHOUSE RACK

[75] Inventor: Frederick A. Mulford, Lodi, N.Y.

[73] Assignee: Hartman Rack Products, Inc., Waterloo, N.Y.

[21] Appl. No.: 98,085

[22] Filed: Sep. 21, 1987

[51] Int. Cl.[4] ..... A47B 88/00; F16C 33/22

[52] U.S. Cl. ..... 384/20; 384/23; 384/42

[58] Field of Search ..... 384/20, 22, 23, 26, 384/34, 35, 41, 42; 312/330, 341 NR; 29/149.5 R

[56] References Cited

U.S. PATENT DOCUMENTS

| | | | |
|---|---|---|---|
| 2,022,917 | 12/1935 | Larkin et al. | 384/42 |
| 2,606,091 | 8/1952 | Buchy et al. | 312/341 NR |
| 2,646,333 | 7/1953 | Abrahamson et al. | 312/346 |
| 2,759,773 | 8/1956 | Wilmer et al. | 384/23 |
| 2,789,025 | 4/1957 | Regenhardt | 312/342 |
| 2,822,232 | 2/1958 | Lhota | 312/341 NR |
| 3,649,090 | 3/1972 | Dutot | 384/23 |
| 4,114,945 | 9/1978 | Lutz | 384/42 X |
| 4,553,792 | 11/1985 | Reeve | 384/26 |
| 4,565,125 | 1/1986 | Khan | 384/42 X |

*Primary Examiner*—Stuart S. Levy
*Assistant Examiner*—Thomas R. Hannon
*Attorney, Agent, or Firm*—Stonebraker, Shepard & Stephens

[57] ABSTRACT

A glide (10) for a shelf (25) of a mini-load warehouse rack has a bearing plate (12) held in place on the shelf by a detent (24) raised up from the upper surface (26) of the shelf and fitting a hole (18) in the bearing plate. A clip (14) on an edge (15) of the guide fitting around an inner edge (27) of the shelf resiliently engages an underside (28) of the shelf to hold the bearing plate in its locked position on the detent. Trays (30) can slide in and out on the shelf glides without dislodging the bearing plates from the detents.

22 Claims, 2 Drawing Sheets

GLIDE SYSTEM FOR MINI-LOAD WAREHOUSE RACK

BACKGROUND

Mini-load warehouse racks use steel trays or pans that hold small parts or objects for storage and slide in and out on shelves formed on the racks. The racks are made of steel, can be several stories tall, and can support the building that contains them. Each of the shelves supporting a tray is formed of a pair of opposed angle irons welded between vertical rack elements. A computerized robot moves the trays in and out of their angle iron shelf supports.

To prevent metal-to-metal contact of the steel trays sliding back and forth on the steel shelves, glides are required on the shelves. These have generally been formed of a resin material such as nylon, and pop rivets have been used for riveting the resin glides or bearings onto the upper surface of each shelf angle. The pop riveting is so laborious that the thousands of glides required for a mini-load warehouse rack system constitute about 10% of the cost of the entire rack.

Other ways of attaching the shelf glides to the rack shelves have been attempted, but have failed. Extending the resin material of the glide through a hole in the shelf, for example, is not strong enough, because a resin pin extending through a hole can be sheared off when a tray hits the glide. Since sliding the trays in and out of their shelves is accomplished by a robot, satisfactory shelf glides must be strong enough to withstand direct hits as trays are shoved onto their shelves.

I have devised an improvement in shelf glides for mini-load warehouse racks. My glides are firmly anchored on their shelves to withstand the full force of tray movement, and yet my glides assemble quickly and easily onto the shelves. My glides are also inexpensive to make and substantially reduce the cost of building a mini-load warehouse rack system.

SUMMARY OF THE INVENTION

My glides are retained in place on mini-load warehouse rack shelves by means of detents raised above the upper surfaces of the shelves and holes made in bearing plates of the glides to fit around the detents. Each of the bearing plates rests on the upper surface of a shelf and the hole in the bearing plate encircling the raised detent locks the bearing plate against moving in the direction that the tray moves. A resilient clip extends from one edge of the glide under the shelf and resiliently engages the underside of the shelf to hold the bearing plate in place on the detent. Two detents and two holes can be used for each bearing plate, and the ends of the bearing plates are preferably beveled. The detents are preferably raised to a height above the shelves that is about half the thickness of the shelves, and the bearing plates of the glides are preferably thicker than the height of the detents. The shelves preferably have edge notches that receive the glides when the bearing plates are positioned on the detents.

DRAWINGS

DETAILED DESCRIPTION

Figure 1:
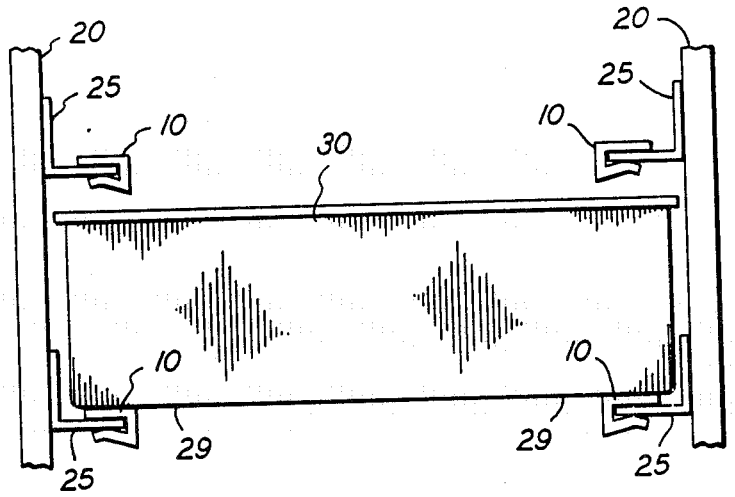
FIG. 1 is a partially schematic front view of a pair of shelves of a mini-load warehouse rack.
Figure 2:
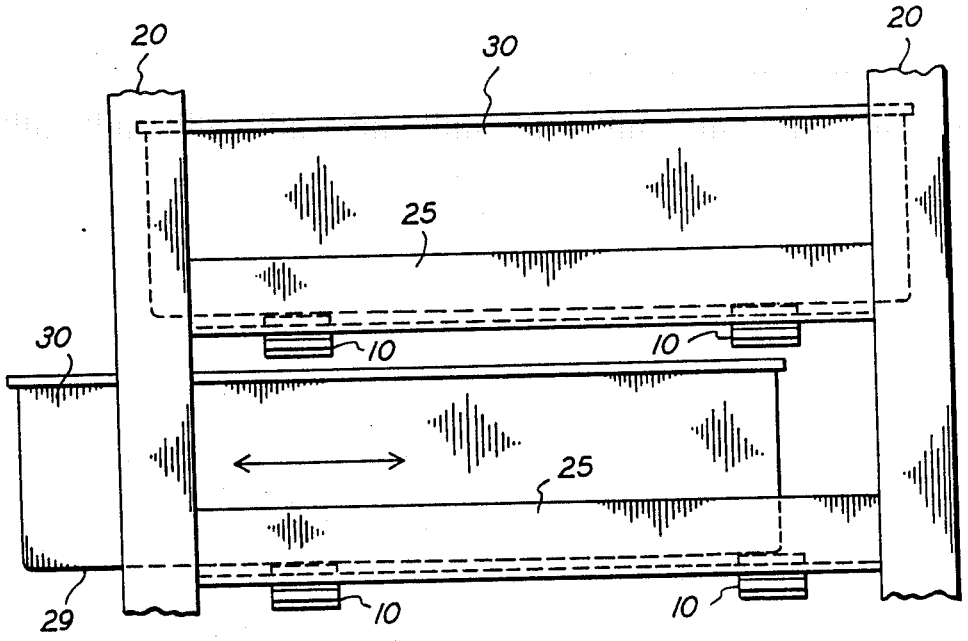
FIG. 2 is a partially schematic side view of the mini-load warehouse rack shelves of FIG. 1.

Mini-load warehouse racks extend vertically, sometimes for several stories, as schematically represented by vertical elements 20 in FIGS. 1 and 2. Spaced vertically along elements 20 are opposed angle iron shelves 25, each of which supports a longitudinal lower edge 29 of a pan or tray 30. Glides 10 on each pair of shelves 25 let the bottom edges 29 of each tray 30 slide in and out of each shelf. The construction of the racks 20, shelves 25, and trays 30 is well-understood in the art of building mini-load warehouse racks; and these components are illustrated only schematically in the drawings. My invention is an improved way of forming and mounting glides 10 on shelves 25, as best shown in FIGS. 3–7.

Each glide 10 includes a bearing plate 12 with a plane bottom 11 that can rest on an upper surface 26 of shelf 25. Ends of bearing plate 12 preferably have bevels 13 that are preferably angled about 30° from the plane of bottom surface 11. One edge 15 of glide 10 fits along an inner edge 27 of shelf 25, and a resilient clip 14 extends from edge 15 beneath bottom surface 11 of bearing plate 12. The inner edge 16 of clip 14 is parallel with edge 15 and is angled away from an underside 28 of shelf 25. Clip 14 also preferably angles toward underside 28 of shelf 25 from edge 15 so that clip 14 resiliently presses toward bottom surface 11 of bearing plate 12 and resiliently engages the underside 28 of shelf 25 to hold glide 10 in place.

Figure 3:
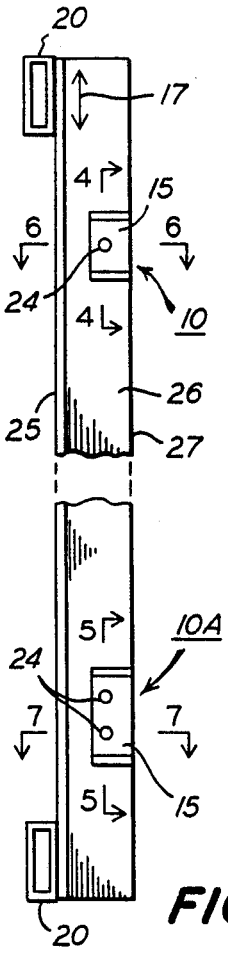
FIG. 3 is a partially cutaway plan view of one of the shelves of FIGS. 1 and 2, showing two preferred embodiments of my glides.
Figure 4:
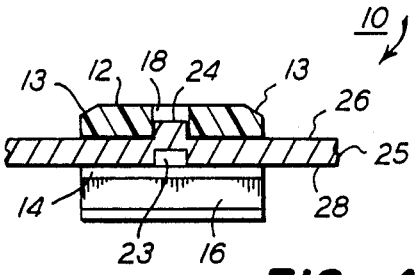
FIGS. 4–7 are enlarged cross-sectional views, taken along respectively numbered lines of FIG. 3.
Figure 6:
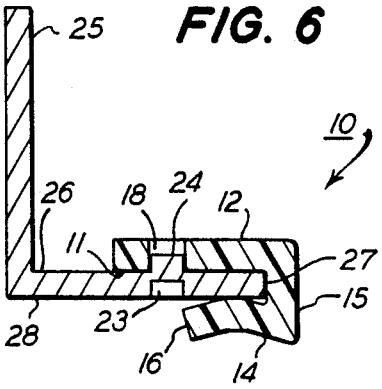
Figure 5:
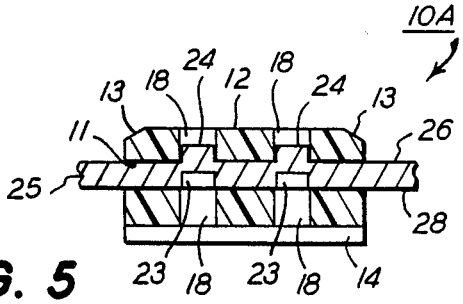
Figure 7:
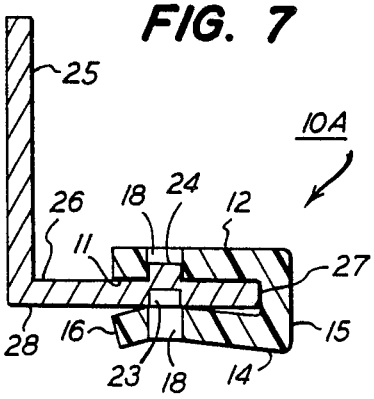

The lateral location of glide 10 in the direction of movement of a mini-load tray, as shown by the arrow 17 in FIG. 3, is accomplished by detent 24. Shelf 25 is punched with male and female dies that offset detent 24 upwardly above upper surface 26 of shelf 25. This produces a corresponding recess 23 in the underside 28 of shelf 25 underneath detent 24. Bearing plate 12 has a hole 18 that fits around detent 24, which holds bearing plate 12 against movement force of tray 30.

Detent 24 is preferably raised above upper surface 26 of shelf 25 by about one-half the thickness of shelf 25. Angle iron ⅛th inch thick is typically used for mini-load warehouse racks so that detent 24 is preferably elevated above upper surface 26 of shelf 25 by about 0.062 inches. This much of an offset for detent 24 is readily formed in the steel of shelf 25 and is adequately strong to hold bearing plate 12 in place. The same machinery that presently forms shelves 25 can be made to form detents 24, so that their cost is negligible.

Bearing plate 12 is preferably thicker than the height of detent 24 above shelf 25. This ensures that tray surface 29 rides on bearing plate 12 above the top of detent 24 and allows bearing plate 12 to wear down a little before tray surface 29 touches the top of detent 24. For a detent raised 0.062 inches above shelf surface 26, bearing plate 12 is preferably about 0.125 inches thick. This may be thicker than necessary, however, because experience so far has shown no noticeable wear on the upper surface of bearing plate 12.

Figure 8:
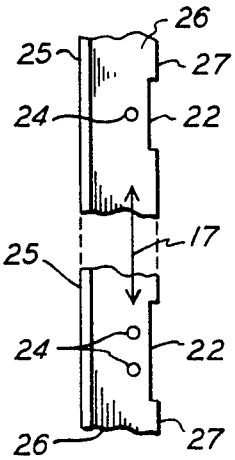
FIG. 8 is a fragmentary plan view of the shelf of FIG. 3, showing the preferred shelf edge notches.

Further resistance to lateral movement of glides 10 is preferably provided by a notch 22 formed in the inside edge 27 of each shelf 25, as shown in FIG. 8. Notches 22 are formed alongside detents 24, preferably with the same machinery that forms detents 24, so that notches 22 do not add significantly to the cost of the shelves. Each notch 22 is relatively shallow (⅛th inch deep, for example) and extends for the length of the glide 10 or 10A that will mount on detents 24. When the glides are mounted on detents 24, glide edges 15 enter and interlock with notches 22, to help support glides 10 against movement in the direction that the trays move, as shown by arrow 17.

Glide 10 is preferably extruded of a resilient resin material such as an ultra-high molecular weight resin of the nylon type. Nylons that include graphite can also be used, and polytetrafluoroethylene is another possibility. The qualities desired are a firm wear surface for bearing plate 12, durability, economy, and sufficient resilience for clip 14. Glides 10 are then cut to length from an extrusion and provided with bevel ends 13 and holes 18. Clip 14 can terminate at an edge 16 adjacent hole 18, so that a hole is formed only in bearing plate 12. The axis of hole 18 is perpendicular to plane bottom surface 11 of bearing plate 12.

Glide 10A, also shown in FIG. 3, is similar to glide 10, except for being longer and having two holes 18 mating with two detents 24. Its clip 14 also extends farther to its open end 16 so that hole 18, punched through bearing plate 12, may also be punched through clip 14.

To mount glides 10 and 10A in place, it is merely necessary to slide bearing plate 12 over edge 27 and upper surface 26 of shelf 25. As this occurs, bearing plate 12 rides over one or more detents 24, and shelf edge 27 moves into the slot formed by the spacing of clip 14 from bottom surface 11 of bearing plate 12. Clip 14 resiliently springs away from bottom surface 11 to accommodate this movement as bearing plate 12 slides over shelf 25. When the single or double detents 24 move into holes 18, bearing plate 12 drops down over the detents, bringing bottom surface 11 into firm engagement with upper surface 26 of shelf 25. In this position, detent 24, extending into hole 18, prevents any movement of bearing plate 12 in the direction of movement of a tray 30, and the preferred seating of glide edge 15 in notch 22 assists in holding bearing plate 12 firmly in place. Clip 14, resiliently pressing against the underside 28 of shelf 25, holds bearing plate 12 firmly against upper surface 26 and maintains the interlock between detents 24 and holes 18. Glides 10 or 10A can be removed from shelf 25 by springing clips 14 to raise bearing plates 12 up off of detents 24.

The mounting of glides 10 or 10A onto shelves 25 can be done manually and can be assisted by a mallet. The work proceeds much more rapidly than the prior art method of pop riveting glides onto shelves. Since glides 10 and 10A are economical to make, they substantially reduce the cost of manufacturing mini-load warehouse rack systems by reducing the labor involved in mounting glides in place.

I claim:

1. In a glide system for a tray shelf of a mini-load warehouse rack, the improvement comprising:

a. a detent formed in said shelf to extend upward from an upper surface of said shelf;

b. a resin bearing having a bearing plate thicker than the height of said detent above said upper surface of said shelf, said bearing plate having a plane bottom side for resting on said shelf and a resilient clip spaced below and confronting said bottom side;

c. said bearing plate having a through hole sized to fit around said detent; and d. said clip being resiliently movable away from said bottom side to allow said bearing plate to be slid over said detent to position said hole around said detent while said clip slides into a gripping position against an underside of said shelf.

2. The improvement of claim 1 wherein ends of said bearing plate are beveled.

3. The improvement of claim 1 wherein said detent is formed by offsetting a circular region of said support element upward relative to said upper surface.

4. The improvement of claim 3 wherein said height of said detent is about one-half the thickness of said shelf.

5. The improvement of claim 1 including a pair of said detents and a mating pair of said holes in said bearing face.

6. The improvement of claim 1 wherein an edge of said shelf has a notch that receives said clip when said hole is around said detent.

7. A shelf glide for a mini-load warehouse rack, said glide comprising:

a. a resin body having a bearing plate with a plane bottom surface and a resilient clip spaced below said bottom surface and extending parallel with said bottom surface to confront said bottom surface;

b. a detent-receiving through hole in said bearing plate, an axis of said hole being perpendicular to said bottom surface; and c. said clip extending from one edge of said bearing plate to form a slot closed along said one edge so that when said bearing plate is positioned on an upper surface of a shelf of said rack, with said one edge extending along an edge of said shelf, said clip extends under and resiliently engages an under surface of said shelf.

8. The glide of claim 7 wherein end regions of said bearing plate are beveled.

9. The glide of claim 7 including a pair of said detent-receiving holes in said bearing plate.

10. The glide of claim 7 wherein said clip is angled away from said bottom surface of said bearing plate at an open edge of said slot and angled toward said bottom surface of said bearing plate at a closed end of said slot along said one edge of said bearing plate.

11. A method of making and mounting a glide on a tray supporting shelf of a mini-load warehouse rack, said method comprising:

a. extruding a glide of resilient resin material to form a bearing plate having a flat bottom surface and a resilient clip extending along one edge of said bearing plate in a region opposite from and confronting said bottom surface;

b. forming a detent-receiving hole through said bearing plate;

c. forming a detent offset upwardly from an upper surface of said shelf; and d. sliding said glide laterally onto said shelf so that said bearing plate moves over said detent to mate said hole with said detent and position said bottom surface of said bearing plate against said upper surface of said shelf, while said clip resiliently engages an underside of said shelf.

12. The method of claim 11 including beveling end regions of said bearing plate.

13. The method of claim 11 including forming a pair of said detent-receiving holes in said bearing plate and forming a mating pair of said detents on said shelf.

14. The method of claim 11 including forming the height of said detent above said upper surface of said shelf to be about one-half the thickness of said shelf.

15. The method of claim 11 including forming said bearing plate to be thicker than the height of said detent above said upper surface of said shelf.

16. The method of claim 11 including forming a notch in an edge of said shelf to receive said clip when said detent mates with said hole.

17. A glide system for storage trays sliding in and out on shelves of a mini-load warehouse rack, said glide system comprising:

a. a plurality of glides mounted on a pair of said shelves for each of said trays;

b. each of said glides having a bearing plate with a plane bottom surface resting on an upper surface of one of said shelves;

c. each of said shelves, in the region of each of said bearing plates, having a detent that is offset upwardly from said upper surfaces of said shelves;

d. each of said bearing plates having a through hole fitting one of said detents; and e. each of said glides having a lateral edge engaging an edge of one of said shelves and a resilient clip extending from said lateral edge underneath one of said shelves for resiliently engaging an underside of one of said shelves.

18. The system of claim 17 wherein end regions of said bearing plates are beveled.

19. The system of claim 17 including a pair of said through holes in said bearing plates and a mating pair of said detents on said shelves.

20. The system of claim 17 wherein each of said bearing plates is thicker than the height of said detents above said upper surfaces of said shelves.

21. The system of claim 17 wherein the height of said detents above said upper surfaces of said shelves is about one-half the thickness of said shelves.

22. The system of claim 17 wherein said edges of each of said shelves have notches receiving said lateral edges of said glides when said holes fit said detents.

* * * * *